United States Patent [19]

Höfer et al.

[11] 3,942,914

[45] Mar. 9, 1976

[54] FUEL INJECTION PUMP

[75] Inventors: Gerald Höfer, Flacht; Karl Konrath, Ludwigsburg, both of Germany

[73] Assignee: Robert Bosch GmbH, Stuttgart, Germany

[22] Filed: Oct. 8, 1974

[21] Appl. No.: 513,065

[30] Foreign Application Priority Data

Oct. 26, 1973 Germany ..... 2353737

[52] U.S. Cl. ..... 417/289; 417/485; 417/494; 123/139 BD; 123/140 A; 417/500

[51] Int. Cl.[2]. F04B 23/00; F04B 41/00; F04B 7/04; F02M 39/00

[58] Field of Search ..... 417/289, 494, 499, 485, 417/500; 123/140 A, 139 AR, 139 AD, 139 AE, 139 BD

[56] References Cited

UNITED STATES PATENTS

| | | | |
|---|---|---|---|
| 2,813,523 | 11/1957 | Bischoff | 417/494 X |
| 3,023,705 | 3/1962 | Heiser | 123/139 BD X |
| 3,635,603 | 1/1972 | Eheim | 417/289 X |
| 3,638,631 | 2/1972 | Eheim | 123/140 A X |
| 3,758,241 | 9/1973 | Eheim | 417/499 X |

*Primary Examiner*—C. J. Husar
*Assistant Examiner*—Richard E. Gluck
*Attorney, Agent, or Firm*—Edwin E. Greigg

[57] ABSTRACT

A fuel injection pump for internal combustion engines includes a pump piston whose simultaneous reciprocation and rotation distributes pressurized fuel to the several injection nozzles of the engine. In order to shift the onset of fuel injection towards a later time during the delivery stroke of the piston, relief channels are disposed in the piston and in the surrounding cylindrical bushing. An annular slide, moving coaxially with respect to the piston, cooperates with the terminal apertures of one or more of these relief channels to relieve the fluid pressure in the working chamber of the pump, thereby interrupting fuel injection to the nozzles of the engine.

4 Claims, 2 Drawing Figures

FUEL INJECTION PUMP

BACKGROUND OF THE INVENTION

The invention relates to a fuel injection pump for internal combustion engines having a simultaneously reciprocating and rotatihg pump piston serving as a fuel distributor. The fuel quantity is delivered by the pump in dependence on engine rpm. For this purpose, the fuel delivery may be interrupted by opening a first relief channel, connected to the pump working chamber, by means of a fuel quantity regulating member. The pump also includes a second relief channel connected to the pump working chamber which is first opened by the pump piston and then closed again after a predetermined delivery stroke has been executed.

In a known fuel injection pump of this kind, the delivered fuel quantity is regulated by opening a first relief channel connected to the pump working chamber by means of a hydraulically driven reciprocating regulating member operating on the principle of a so-called "fluid stop." In order to achieve a load-dependent shift of the onset of injection to a later time when the load decreases, this system is provided with a second relief channel which is so controlled by cooperation of an annular groove on the pump piston and an annular groove on the regulating member that the second relief channel is first opened and then closed again by the annular groove on the pump piston; the opening occurring earlier when the "fluid stop" is rising corresponding to a decreasing injected fuel quantity or decreasing load. An injection pump of this type is very expensive and requires substantial changes in the body of the pump so as to realize the described regulation process.

OBJECT AND SUMMARY OF THE INVENTION

Accordingly, it is the primary object of the invention to provide a fuel injection pump which performs an increasing shift of the onset of fuel delivery towards a later time when the load decreases and which regulates the delivered fuel quantity by opening a relief channel by means of an annular slide which cooperates with the pump piston. The entire process is to be achieved with simple means and without making substantial changes in the basic construction of the pump.

This object is achieved, according to the invention by providing a pump piston which includes a first relief channel and the second part of a second relief channel. Both of the channels have an exit aperture leading to the pump suction chamber. The exit aperture of the first relief channel is opened or closed by an annular slide moving on the pump piston and serving as a fuel quantity regulating member. The opening occurs at a time which is later than the opening of the exit aperture of the second part of the second relief channel by the annular slide. The second part of the second relief channel within the piston also has a second exit aperture which communicates with a first part of the second relief channel leading to the pump working chamber when the pump piston is in its lowest positon. This communication is interrupted again after the pump piston has executed a predetermined part of its delivery stroke.

An advantageous embodiment of the invention further provides that the second exit aperture of the second part of the second relief channel terminates in an exterior annular groove on the pump piston and that the first part of the second relief channel is disposed within a cylindrical bushing which is inserted into the housing of the pump and in which the piston moves. Thus, in an advantageous manner, the shift of the onset of the fuel delivery towards a later time with decreasing load requires only small changes in the form of the cylindrical bushing and of the pump piston, the change in the piston being, in fact, to provide therein an additional bore with two connecting, transverse bores so as to serve as the second part of the second relief channel. These changes can be made simply and without substantially changing the basic construction of the pump.

Another very advantageous embodiment of the invention provides that the first part of the second relief channel consists, firstly, of an interior annular groove within a bushing inserted in the pump housing to serve as a cylinder for the pump piston; and, secondly, of a transverse bore branching off from the first relief channel and terminating in this interior annular groove. The transverse bore cannot be closed by the pump piston during its fuel delivery stroke any sooner than the time of closure of the second exit aperture of the second part of the second relief channel. In this embodiment, only a very small change of the cylindrical bushing is required so that the object of the invention is attained in a favorable manner.

BRIEF DESCRIPTION OF THE DRAWING

The drawing depicts two exemplary embodiments of the invention which will be described in detail below.

DESCRIPTION OF THE PREFERRED EMBODIMENTS

Figure 1:
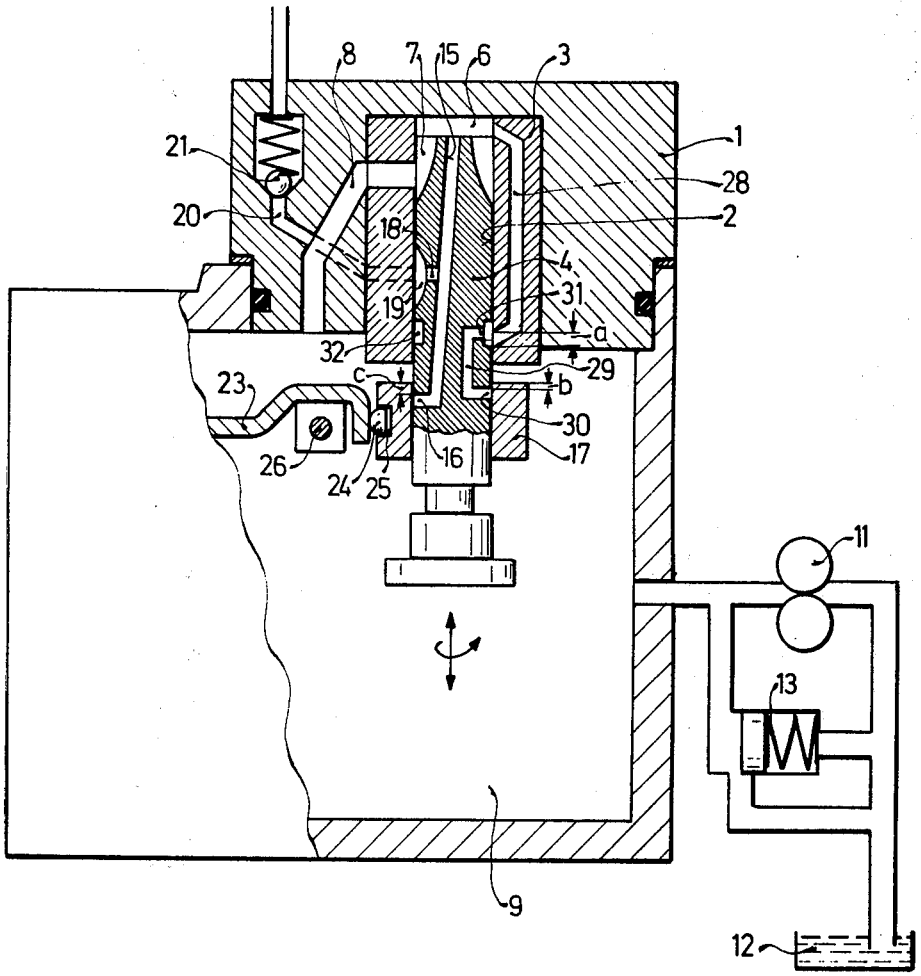
FIG. 1 is a partly sectional diagram of a first exemplary embodiment of the invention in which a first part of the second relief channel lies within a cylindrical bushing.

The housing 1 of a fuel injection pump includes a cylindrical bushing 3 with a bore 2 within which a pump piston 4 is arranged to simultaneously reciprocate and rotate under the influence of means (not shown) and against the force of a restoring spring (also not shown). A drive mechanism of this type is described, for example, in U.S. Pat. No. 3,758,241. The working chamber 6 of this pump is supplied with fuel which is taken from a suction chamber 9 and flows through a bore 8 lying within the housing 1 and penetrating the cylindrical bushing 3. The fuel then flows along a longitudinal groove 7 disposed in the periphery of the pump piston. Fuel supply takes place during the suction stroke of the piston and/or at its bottom dead center position. A fuel pump 11 supplies fuel from a fuel tank 12 to the suction chamber 9. In a known manner, a pressure control valve 13 controls the pressure within the suction chamber 9 in dependence on rpm so that, as the rpm increases, so does the fuel pressure in the suction chamber in a predetermined manner. A mechanism of this type is described, for example, in U.S. Pat. No. 3,638,631.

The pump piston 4 includes a generally longitudinally extending channel 15 that communicates with an exit aperture 16 thereby permitting association of the working chamber 6 with the suction chamber 9 of the pump. The opening and closing of the exit aperture 16 is controlled by an annular slide 17 which cooperates with the pump piston. The part of the pump piston 4 that extends into the cylindrical bushing 3 also contains a transverse bore 18 which branches off from the longitudinal channel 15 and terminates in a longitudinal distribution groove 19 disposed in the outer surface of the pump piston.

During the delivery stroke of the pump piston 4, and after its rotation has obturated the bore 8, one of the pressure lines 20 is connected to the pump working chamber 6 via the longitudinal channel 15, the transverse bore 18 and the longitudinally extending distribution groove 19 connected therewith. Each of the pressure lines 20 leads to a check valve 21 and to an individual injection nozzle belonging to one of the cylinders of an internal combustion engine (not shown). The number of pressure lines 20 is the same as the number of cylinders in the engine. These lines are suitably distributed on the circumference of bore 2. During the delivery stroke of the pump piston 4, fuel is thus transported through the longitudinal channel 15 to the injection nozzles as long as the exit aperture 16 of the longitudinal channel 15 remains obturated due to the presence of the annular slide 17.

The annular slide is displaced on the pump piston by an rpm governor (not shown) in dependence on load and rpm. A mechanism of this type is described, for example, in U.S. Pat. No. 3,638,631. The governor acts via an intermediate lever 23 pivoting about an axis 26. Its head 24 is received in a recess 25 provided within the annular slide 17. A downward motion of the annular slide 17 due to pivoting of the intermediate lever has the effect that the exit aperture 16 of the longitudinal channel 15 is opened earlier during the delivery stroke of the pump piston 4. Thus, the pump working chamber 6 is pressure relieved and no more fuel is delivered into the pressure lines 20. Thus, the longitudinal channel 15 serves as a first relief channel for the pump working chamber. The farther the annular slide 17 is displaced downwardly, the smaller is the fuel quantity delivered to the internal combustion engine. When the annular slide 17 is in its uppermost position, the exit aperture 16 is no longer opened at all during the delivery stroke of the pump piston 4 so that the maximum fuel quantity deliverable by the pump piston 4 is actually injected. This position of the annular slide corresponds to the full-load position.

Further branchng off from the pump working chamber 6 is a second relief channel whose first part 28 lies within the cylindrical bushing 3 and which terminates in the bore 2 of cylinder 3 near its lower end. Also disposed within the pump piston 4 is a second part 29 of the second relief channel whose exit aperture 30 leads to the pump suction chamber 9 in the operational region of the annular slide 17. It also has a second exit aperture 31 which terminates in an annular groove 32 disposed on the periphery of the pump piston 4. The annular groove 32 cooperates with the terminus of the first part 28 of the second relief channel and communicates with it when the pump piston is in the dead center position shown in FIG. 1. The annular slide 17 always opens the exit aperture 30 of the second relief channel sooner than the exit aperture 16 of the first relief channel 15, as is clearly illustrated in the drawing.

The control process for the second relief channel is as follows:

If the rpm governor (not shown) has caused the annular slide 17 to be moved into a central position such as shown in FIG. 1, the communication of the first part 28 of the second relief channel with the annular groove 32 and, hence, also with the second part 29 of the second relief channel is interrupted after the pump has executed a delivery stroke of length *a*.

Now, after the pump piston has executed a delivery stroke of length *b*, the exit aperture 30 is opened by the annular slide 17. For a central position of the annular slide, such as is shown in the drawing, the length *b* is smaller than the length *a*, so that, during the delivery stroke, and at a time when the first relief channel 15 is still obturated by the annular slide 17, the working chamber 6 is briefly pressure-relieved via the first part 28 and the second part 29 of the second relief channel. As a consequence, no fuel is injected during this part of the stroke. The fuel quantity flowing out through the second relief channel is equal to the quantity which the pump piston 4 delivers during a stroke equal to the difference of the stroke length *a* minus the stroke length *b*. After the pump piston 3 has executed a stroke length *c*, the first relief channel 15 is opened via the exit aperture 16 and hence the injection process is terminated. In all cases, the stroke length *c* is greater than the stroke length *b* after traversal of which the annular slide 17 opens the exit aperture 30 of the second part 29 of the second relief channel.

The farther the annular slide 17 is moved downwardly in the sense of reducing the injection fuel quantity, the shorter is the length of the stroke *b*, i.e., the sooner the aperture 30 of the second part 29 of the second relief channel 29 is opened and the greater is the fuel quantity which can flow off through the mutually communicating parts 28, 29 of the second relief channel. The main portion of the fuel injection process, which occurs after the piston has completed a stroke of length *a* and prior to opening the first relief channel, is thus shifted towards a later time for a decreasing load or for increasing rpm. However, when the annular slide 17 is displaced upwardly for the purpose of delivering a full-load fuel quantity, the stroke length *b* increases and becomes equal to or greater than the stroke length *a*, so that, even before the exit aperture 30 of the second part 29 of the second relief channel is opened, the communication between the anular groove 32 and the first part 28 of the second relief channel has already been interrupted. In this case, no fuel can flow out through the second relief channel.

Once the pump has been assembled, the stroke length *a* is fixed but it can be varied during the assembly of the pump, for example, by inserting intermediate discs adjacent to the driven face of the pump piston 4, as well as adjacent to the face of the cylinder bushing 3 inserted in the housing 1, or between the two parts of a two-part housing.

Figure 2:
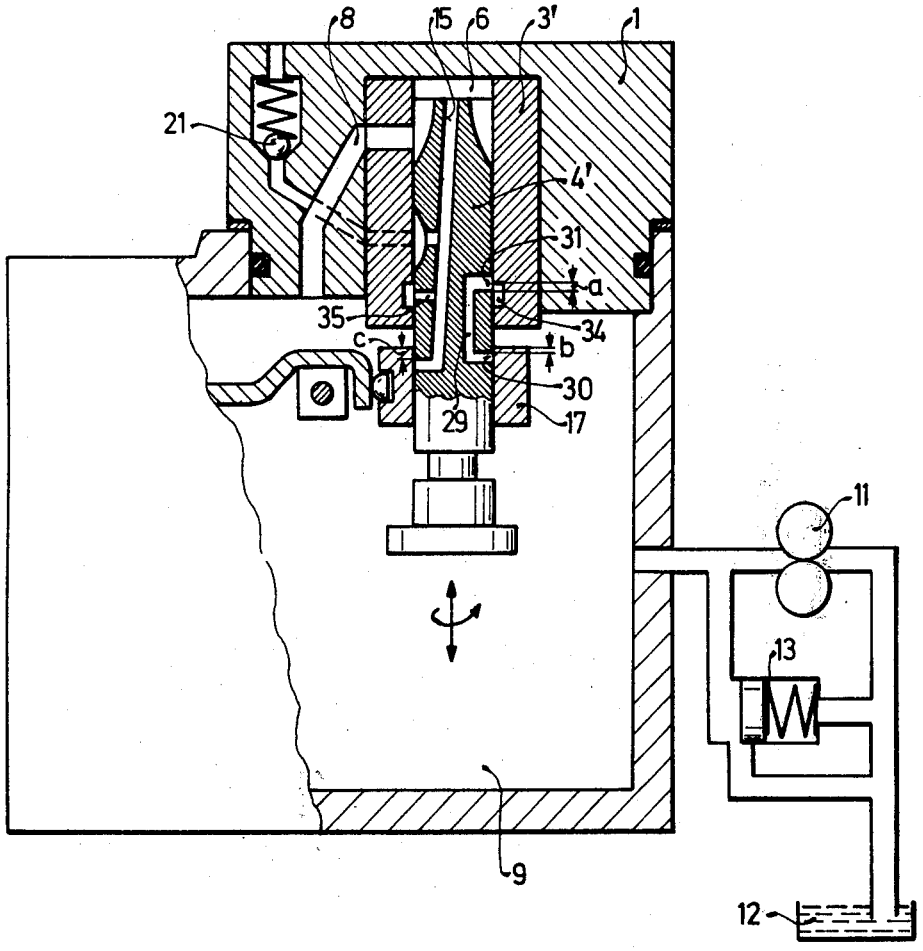
FIG. 2 depicts a second exemplary embodiment of the invention in which a part of the first relief channel also serves as the second relief channel.

The exemplary embodiment according to FIG. 2 is substantially identical to that of FIG. 1 and also functions in substantialy the same way. The only difference lies in the disposition of the second relief channel. In this case, the second part 29 of the second relief channel has the same initial extent but the second exit aperture 31 terminates in an interior annular groove 34 within the cylindrical bushing 3'. Furthermore, in the bottom position of the pump piston, as shown in FIG. 2, a transverse bore 35 in pump piston 4' branches off from the first relief channel 15 and terminates in the interior annular groove 34. Thus, in this embodiment, the first part of the second relief channel is formed by the annular groove 34, the transverse bore 35 and a portion of the first relief channel 15.

The control process for the second relief channel is the same as was described for the previous example. In the initial position of the pump piston 4', corresponding to its bottom dead center position, the exit aperture 30 of the second part 29 of the second relief channnel is closed by the annular slide 17 which may, for example, be in its central position. At the same time, the second exit aperture 31 communicates with the interior annular groove 34 which, in turn, communicates through the transverse bore 35 and through the first relief channel 15 with the pump working chamber 6. After the pump piston 4' executes a delivery stroke of length *b*, the exit aperture 30 of the second relief channel is opened by the annular slide 17, whereas, after a stroke length *a*, the communication between the second exit aperture 31 of part 29 of the second relief channel and the interior annular groove 34 is interrpted. During the stroke difference $a - b$, the fuel delivered by the pump piston 4 may flow out of the pump working chamber 6 through the first relief channel 15, the transverse bore 35, the interior annular groove 34 and the second part 29 of the second relief channel.

Both of the described mechanisms achieve the object of shifting the onset of injection towards a later time for a decreasing load and only small changes are necessary to the basic construction of the injection pump to accomplish this objective. In particular, replacement of the cylindrical bushing 3 or 3' permits conventional operation of the injection pump. The same purpose may be achieved by exchanging pump pistons.

What is claimed is:

1. In a fuel injection pump associated with an internal combustion engine including a housing within which a suction chamber is defined, a cylindrical bushing mounted within said housing, a bore defined within said bushing, a pump piston mounted within the bore for axial and rotary motion therein, a pump work chamber defined by the housing, the bushing and the piston, outlet pressure lines connecting said chamber with associated injection nozzles, a first relief channel connected to the pump work chamber, a second relief channel connected to the pump work chamber, and an annular slide serving as a fuel quantity regulating member adapted for changing the fuel quantity delivered by the fuel injection pump as a function of engine rpm by opening the first relief channel so as to permit the first relief channel to connect the work chamber to the suction chamber the improvement wherein:

a. said second relief channel includes a first and second part;

b. said first part of said second relief channel leads to said work chamber;

c. said first relief channel and the second part of said second relief channel are formed within said pump piston;

d. said first relief channel and said second part of said second relief channel include apertures which open into said suction chamber, with the relative position of said aperture being such that said annular slide opens the aperture of said second part of said second relief channel before it opens the aperture of said first relief channel; and e. said second part of said second relief channel includes a further aperture which communicates with the first part of said second relief channel when the pump piston is at its bottom dead center and which is displaced from said communiction when the pump piston has executed a predetermined part of its fuel delivery stroke.

2. An improved fuel injection pump as defined in claim 1, wherein said pump piston is further provided with an annular groove communicating with said second part of said second relief channel, and wherein the first part of said second relief channel is formed within said cylindrical bushing.

3. A fuel injection pump as defined in claim 2, wherein said relief channels and said annular groove are so disposed that the stroke executed by said pump piston after which the communication between said second part of said second relief channel with said first part of said second relief channel is interrupted is adjustable to be of different length from the stroke executed by said pump piston from its bottom dead center position up to the position where communication is established between said second part of said second relief channel and said suction chamber.

4. An improved fuel injection pump as defined in claim 1, wherein said first part of said second relief channel comprises an annular groove formed in said cylindrical bushing and further comprises a transverse channel formed in said pump piston and communicating with said first relief channel therein, and wherein said annular groove and said transverse channel are so disposed that during the fuel delivery stroke of said pump piston the transverse channel is closed off not sooner than the closure of said further aperture of said second part of said second relief channel.

* * * * *